United States Patent [19]

Ostrowski

[11] 3,965,551

[45] June 29, 1976

[54] PRODUCTION OF POLYMER-COATED STEEL TUBING

[75] Inventor: Arthur E. Ostrowski, Crete, Ill.

[73] Assignee: Allied Tube & Conduit Corporation, Harvey, Ill.

[22] Filed: Aug. 14, 1975

[21] Appl. No.: 604,622

[52] U.S. Cl. ..... 29/33 D

[51] Int. Cl.[2] ..... B21B 15/00

[58] Field of Search ..... 29/33 D

[56] References Cited

UNITED STATES PATENTS

| | | | |
|---|---|---|---|
| 2,782,743 | 2/1957 | Kennedy | 29/33 D X |
| 3,579,772 | 5/1971 | Coad | 29/33 D |
| 3,639,970 | 2/1972 | Larkin | 29/33 D |
| 3,667,095 | 6/1972 | Ostrowski | 29/33 D |

FOREIGN PATENTS OR APPLICATIONS

| | | | |
|---|---|---|---|
| 46-14528 | 4/1971 | Japan | 29/33 D |

*Primary Examiner*—Harrison L. Hinson
*Attorney, Agent, or Firm*—Fitch, Even, Tabin & Luedeka

[57] ABSTRACT

Lengths of polymer-coated tubing are continuously produced from steel strip by roll-forming and welding at a fast rate of speed. The welded tubing is sized, cleaned and heated to raise its temperature to that desired for applying a polymeric coating. After coating, the tubing is heated to a desired baking temperature and then cooled. The tubing is unsupported from a location upstream of the coating station until cooled. Elongated endless belts grip the tubing over a longitudinal distance of at least about 2 feet and pull the tubing in a controlled manner to maintain the tubing in precise spatial location throughout its heating, coating and baking.

15 Claims, 2 Drawing Figures

PRODUCTION OF POLYMER-COATED STEEL TUBING

This invention relates to the continuous forming and coating of tubing, and more particularly to forming steel tubing from strip steel stock and providing a uniform polymeric coating on the exterior of said tubing. It is well known to produce endless lengths of welded steel tubing from strip stock and to continuously galvanize that tubing by providing a zinc coating on the exterior surface as taught, for example, in U.S. Pats. Nos. 3,122,114 and 3,230,615 which are owned by the assignee of this patent application. It is likewise known to continuously apply polymeric coatings to the exterior of such continuously formed tubing, employing various thermoplastic and thermosetting resins, as for example taught in U.S. Pats. Nos. 3,559,280, 3,616,983 and 3,667,095.

It is the object of the present invention to provide improved methods and apparatus for the production of continuous tubing from steel strip while continuously applying a polymeric coating to the exterior of the tubing and carrying out the overall operation at a high rate of speed. Another object is to provide improved apparatus for producing coated steel tubing of the type just above-mentioned in desired lengths which has an unblemished exterior coating finish.

The present invention achieves the foregoing objects by employing a take-off assist device of specific construction at a location just upstream of the traveling shear which cuts the tubing to employs The take-off assist device is which to engage the endless length of coated tubing in a manner so as to exert a pulling force thereupon without blemishing the exterior polymeric surface coating. The take-off assist device employs a pair of endless belts which flank the path of the endless length of tubing, preferably top and bottom, and which are constructed so as to engage the moving tubing over a substantial distance and carefully controlled in a manner to exert a pulling force upon the coated tubing that is matched to the speed of the continuous tube mill within very close tolerances. As a result, surface contact with the tubing can be avoided from a location prior to preparation for coating to a location following cooling of the polymeric coating.

Figure 1:
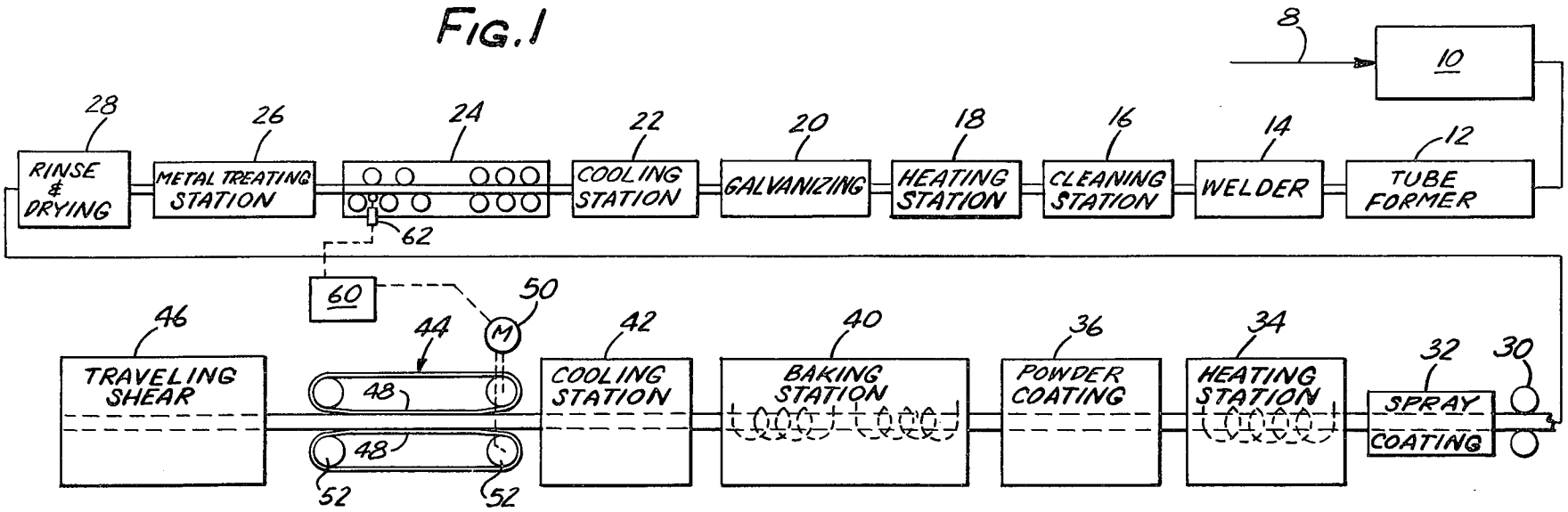
Figure 2:
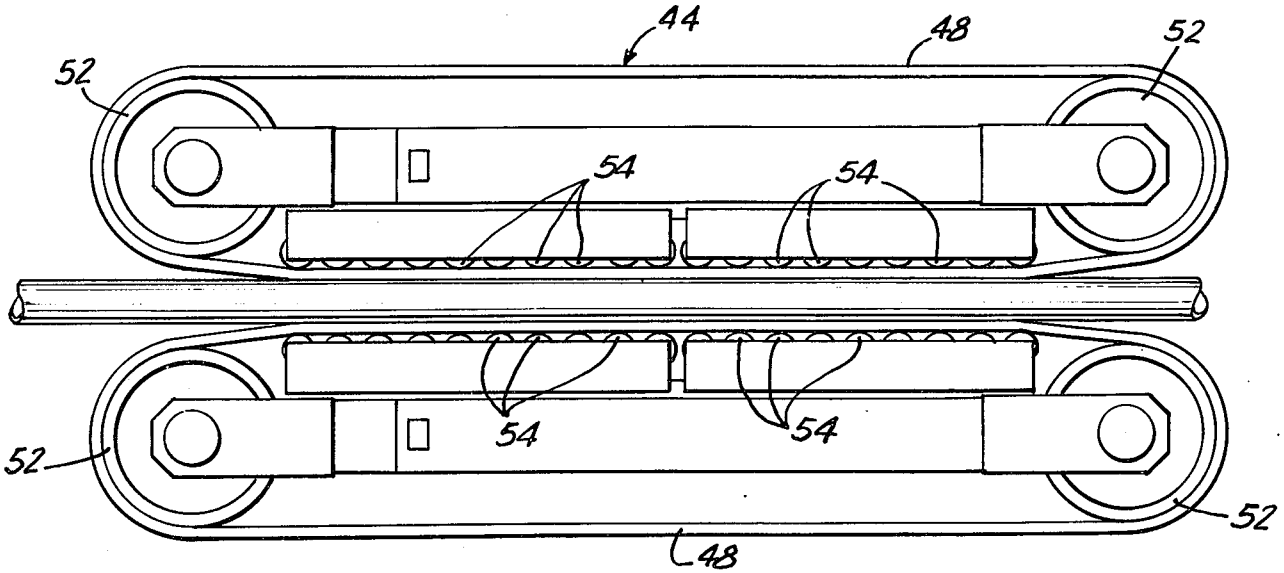

FIG. 1 illustrates a diagrammatic view of a production line arrangement embodying various features of the present invention for carrying out continuous forming, galvanizing, and coating operations in the production of lengths of coated tubing; and FIG. 2 is an enlarged view of the take-off assist device shown in FIG. 1.

A preferred embodiment of apparatus made in accordance with the invention is illustrated in FIG. 1 wherein certain stations are shown only diagrammatically, particularly the upstream portion of the production line wherein the continuous forming, welding and galvanizing occurs. A more detailed description of these various stations is found in the aforementioned patents.

Although the overall production line is illustrated as including a galvanizing station, as well as a station where a primer coating can be applied, in its broadest aspects, the invention is considered to be valuable whether or not the formed and welded tubing is first galvanized, and the use of the primer coating station is clearly optional. On the other hand, although the following detailed description is directed to the application of a polymeric coating in powdered form at a powder-coating station, should it be desired to apply the polymeric coating as a part of a solvent-based liquid system, the station denoted the primer station could be used for this purpose and the powder-coating station inactivated. On the other hand, if an extrusion coating should be desired, suitable equipment could be substituted for that at the spraycoating station. Likewise, although the term "galvanizing" is used, this term is employed in its broadest sense and not intended to be restricted to the employment of pure zinc as, for example, an alloy of zinc with aluminum could be used.

The overall apparatus of FIG. 1 depicts a production line in which each of the stations is considered to be treating steel strip moving from right to left. At the upper righthand corner, strip 8 is shown which is being supplied from a suitable roll source (not shown). The strip travels past an end welder, known in the art for splicing an end of one roll to another roll at the required time, and enters an accumulator 10 wherein a sufficient length of strip is stored to supply the line while adjacent ends are being welded. Likewise, the edges of the strip may be appropriately treated so as to be ready for welding at the time that the strip 8 enters a tube former 12. The tube former 12 is constituted by a series of conventional forming rolls whereby the strip is continuously deformed from its initial flat character to that of a rounded tube with the edges of the strip in approximately abutting relation to form the seam of the tube upon welding.

The continuous tubular form created by the tube-former 12 advances directly to a welder 14 where the edges of the strip are joined by welding, preferably using a continuous resistance welder that is designed to keep the upset on the inside of the formed tubing at a minimum. After the welding is complete and scarfing of the outer surface in the welded region is effected, the tubing is passed to a washing and pickling station 16 where cleaning and removal of oxides occur. This station may include an alkali wash for removing grease from the surface of the tubing, followed by rinsing and then acid treatment for pickling the surface, followed by a further rinse, all of which are well known in the prior art and described in the earlier-mentioned patents.

Following the cleaning station 16, the tubing passes to a first heating station 18 which is located prior to a galvanizing tank 20 and which preferably utilizes induction heating, although other types of heating can be employed to bring the tubing up to the desired temperature prior to its entry into the galvanizing tank 20. In order to guard against oxidation of the cleaned tubing, an inert or nonoxidizing atmosphere, for example, nitrogen, is used to surround the tubing from the time at which it enters the heating station 18 until it passes into the zinc bath. The details of preferred embodiments with respect to providing such an atmosphere are set forth in the aforementioned patents.

In the heating station, the tubing is preferably preheated to a temperature above the melting point of the galvanizing material, and as a result, the continuously moving heated tubing picks up a uniform coating of zinc or zinc alloy as it passes through the tank. Appropriate wiping is effected at the exit from the zinc tank 20 to avoid carrying excess zinc therefrom, and the galvanized tubing proceeds immediately to a cooling station 22, which may be a water-filled quench tank. After cooling to the desired temperature is effected, the galvanized tubing next enters a sizing and straightening station 24.

Following straightening, an optional metal-treating station 26 is provided wherein the galvanized tubing is treated by chromating, phosphating or the like. By treating the galvanized surface with a chromate and nitric acid solution, a zinc chromate outer film is created which provides even greater resistance to oxidation. If such a metal treating station 26 is provided, a rinse and an air dryer station 28 is included immediately thereafter.

In this upstream region of the production line, there is ample opportunity to support the tubing against sagging as a result of gravity, and of course the sizing and straightening rolls provide such support as well as drive the tubing longitudinally. However, the final support 30 for the tubing downstream of the metal treating station 26 until it reaches the take-off assist device is located just past the drying station 28. The support rollers 30 assure both vertical and horizontal alignment of the tubing at the location.

Just downstream of this point of last support, the tubing enters a liquid spraying station 32 where a coating, in liquid form, can be applied, as for example by a plurality of atomizing spray heads. The station 32 is designed to provide a primer coating prior to applying a thicker polymeric coating in powder form at a downstream location, and it is generally used in instances wherein the galvanizing and chromating or phosphating steps are omitted, so that such a primer coating is applied upon the cleaned surface of the welded tubing; however, in some instances it may be desirable to apply a primer over a galvanized surface. Moreover, a primer may also be applied after chromating or phosphating. Usually, the liquid coating composition will be solvent-based (either organic or water), and will include natural or synthetic resinous polymers and may or may not include a pigment. However, should it be desired to provide such a solvent-based coating composition as the final exterior coating of the tubing, then the downstream powder-coating station to be described hereinafter would not be employed. This might occur in a case where the galvanizing and metal treating stations are used and where, in addition, it is desired to provide a translucent polymeric overcoating on the tubing.

The tubing next proceeds to an induction heating station 34 which preheats the tubing prior to its entry into the powder coating station 36 which is next in line. However, whenever a liquid coating is applied to the tubing, the induction heating station 34 serves to dry the coating by removing the remainder of the solvent and to also cure the resin which might be included therein. In those instances where the liquid coating is to serve as the final exterior coating, solvent-release is achieved at the heating station 34.

Under the usual conditions the primary function of the heating station 34 is to raise the temperature of the tubing to that desired for the powder-coating application. This temperature will vary with the particular powder composition being used; however, it will generally be in the range from about 150°F. to about 400°F. Because the tubing will usually already have been either galvanized or coated with a primer, it is not felt necessary to provide a nonoxidizing atmosphere at the induction heating station 34, and in any event, the temperature will usually not be as high as that employed in the heating station 18 just prior to galvanizing.

The powder coating may be applied in any manner suitable for treating a fast-moving article, for example, electrostatically, by a fluidized bed process, or by an electrostatic-fluidized bed process, all of which are known in the prior art. The employment of such powder-coating processes for coating pipe is shown in U.S. Pat. No. 3,616,983. The powder composition will be a plastic material and may include pigments, plasticizers and the like. Both thermoplastic and thermosetting resins may be employed, as for example, polyamides, polyvinylchlorides, polyesters, polyvinylidene chlorides, polyvinylacetates, butyrates, polyolefins, acrylics, epoxys, as well as blends of the foregoing.

It is considered important that it be possible to closely control the thickness of the coating which is applied in this powder-coating operation, and polymeric coating thicknesses between about 0.5 mil and about 25 mils can be applied uniformly by such powder-coating arrangements at the speeds of operation at which it is desired to run the tubing mill. For example, when vinyl coatings are employed, they are usually used at a nominal thickness of about 5 mils. It is feasible to produce vinyl-coated conduit of this type, ranging from about 1.3 inches to 2.4 inches in outer diameter, wherein the thickness of the vinyl coating will uniformly be not less than 4 mils and not more than 6 mils, at high production-line speeds.

Immediately following the powder coating station, the tubing enters a further heating station 40, preferably containing one or more induction heating units, where baking and/or curing of the powder coating takes place. The heating pattern is determined by the specific resin coating composition that is being used, because different heating criteria are employed to obtain the optimum melt-flow of the polymeric coating. A temperature range from about 200°F. to 650°F. is considered to be representative of such baking and/or curing operations, and for example, a temperature of approximately 500°F. might be used for a vinyl coating. Initially the induction heating at the station 40 will begin the actual baking, and the subsequent heating determines the precise melt-flow performance. Of course, the amount of heat absorbed by a continuously moving tube is a function of both time and temperature, and there are many variables, e.g., thickness, color and chemical composition, which influence the baking conditions of the polymeric material.

When a thermosetting polymeric coating is being applied, in addition to the heating which leads up to and achieves the desired melt-flow of coated powder, a final curing is effected after the coating material has been uniformly distributed over the tubing. This curing step, which is the chemical crosslinking of the thermosetting material, is the final stage of the baking operation, and reference is made to earlier mentioned U.S. Pat. No. 3,667,095 with respect to coating with thermosetting resins.

Subsequent to baking, a cooling station 42, preferably utilizing a water quench, is employed to quickly lower the temperature of the polymeric exterior coating to a level that it will not be adversely affected by contact with the take-off assist device 44, which is located immediately thereafter. In addition, the water quench is employed to assure that the heat-history of the coated polymer does not exceed a desired amount, such that degradation or decoloration of the polymeric material might result. An ancillary roller support for the continuously moving tubing could be provided at a location in the water quench station 42 where the temperature of the polymer will have fallen below a suitable level where such contact may occur without detriment to the surface. However, inasmuch as this point would of necessity be quite close to the take-off assist device 44, such additional support might be considered to be unnecessary.

The take-off assist device 44 includes a pair of endless belts 48 which flank the continuously moving tubing, being located respectively above and below. The belts 48 are made of a material having desired frictional characteristics so as not to mar the polymeric coating, such as synthetic rubber, e.g., Neoprene, having an appropriate hardness, e.g., 40 to 50 durometer. The belts 48 are appropriately driven from a single drive means, preferably an electric motor 50, so that both belts will travel at precisely the same speed. Each endless belt 48 is supported on two large pulleys 52 at the forward end and rearward end thereof, and the take-off assist device 44 is constructed so that the upper belt and pulley assembly is movable vertically while the lower belt and pulley assembly is fixed. This arrangement allows the device 44 to be opened and closed in a way to assure that the tubing will be positioned at a precise location.

The take-off assist device 44 is dimensioned so that there is an extended area of contact between each belt 48 and the coated tubing, and this contact should extend for at least 24 inches in length and preferably for more than 36 inches in length. The employment of such an extended area of contact between the coated tubing and the belts 48 contributes substantially to the ability of the device to grip and tension the tubing without marring the just-applied exterior polymeric coating. To assure that the contact is distributed evenly throughout the length of the so-called "compression section" of the belt drive, a plurality of backup idler rollers 54 are provided along the length of the compression section. The rollers 54 have a configuration that mates with the rear surface of the belts, and although a simple V-belt configuration could be used, preferably a multiple-grooved belt 48 and complementary multiple-grooved rollers 54 are employed to assure there is no lateral shifting of the belt. The take-off assist device 44 is designed to drive the belts 48 at a speed up to about 800 feet per minute. For economically practical operation, speeds of at least about 60 to 70 feet per minute are used, and speeds of 400 feet per minute or higher can be obtained using the invention.

The sizing and straightening roll station 24 serves to drive the welded tubing and can be employed to effectively push the tubing through to the traveling shear 46 if the distance is not too great and/or if intermediate support points can be provided along the way for the tubing. Moreover, the rate of speed at which the production line is operated has an effect upon the practicability of pushing the tubing through the exterior coating section.

In the illustrated apparatus, the last point of support 30 for the tubing is located upstream of the spray coating station, and there is no further point of support until the take-off assist device 44 is reached (although, as indicated, a support roller could be provided near the downstream end of the water quench bath). This extended length of tubing will, as a result of the force of gravity, form a natural catenary curve. The depth of the catenary will depend upon the stiffness of the tube being produced and will be a function of the steel material, the wall thickness and the outer diameter. The employment of the take-off assist device 44, particularly when operated to maintain the tubing in tension between it and the sizing rolls, tends to slightly flatten out this catenary.

The control of the drive motor 50 in a manner to maintain a predetermined amount of tension in the tubing assures the precise spatial positioning of the tubing at every location along its length from the straightening rolls 24 to the take-off assist device 44, and it is this preciseness of positioning that allows consistent uniformity to be achieved in the thickness of the coating being applied. Regardless of the coating system used, but particularly when spray nozzles are employed, precise spatial positioning of the longitudinally moving tubing relative to the spray heads is very important. Without using the take-off assist device 44 and relying solely upon the sizing and straightening rolls 24 to push the tubing throughout the coating, baking and cooling stations, every fluctuation in the speed of the straightening rolls will be reflected in the travel of the tubing downstream through the coating stations. Such fluctuations may result, for example, from upstream deviations in the speed at which the tube mill 12 is operating, and if permitted to be reflected in the downstream speed of the tubing, will detract from the uniformity of the exterior coating which is being applied.

A control system 60 for the take-off assist device utilizes an electronic control which receives an input signal from a monitor 62 that is located at the sizing and straightening roll station near the downstream exit thereof. This monitoring device 62 provides the controller 60 with an extremely precise reading of the speed of the tubing. This is important because there will be variations in the speed of the tubing exiting from the sizing and straightening rolls, and it is desired to control the take-off assist device 44 accordingly. These deviations in the speed may occur for various reasons, and one of the most common occurs when the roll of steel strip periodically runs out and needs to be replaced. As pointed out in U.S. Pat. No. 3,259,148, an accumulation device 10, such as a looper, is employed to hold a reserve quantity of the strip so that the trailing end of one roll of strip can be welded to the front edge of the new roll of strip without halting the feed to the tube former 12. As soon as the welding operation is completed, the accumulation device 10 is refilled, and this refilling creates some drag on the strip being fed to the tube mill 12 which slightly slows the speed of the continuous tube production.

Although various means can be provided for precisely monitoring the speed of the tubing exiting from the sizing and straightening rolls, a digital, photoelectric, pulse generator is preferred. This type of generator is commercially available and delivers an exact number of shaped pulses for each revolution of a central shaft. The shaft carries a small pickup wheel which is in surface contact with the undersurface of the tubing. Alternatively, a digital, magnetic, pulse generator might be employed which likewise produces an exact number of output voltage pulses for each revolution of a central shaft. In its operation, an internal gear interrupts the lines of magnetic pickup and provides an alternating output voltage in the form of a sinusoidal wave.

The monitoring device 62 is electrically connected to the controller 60 and thus provides an input to the controller which precisely reflects the speed of the tubing as it exits from the sizing and straightening rolls 24. The controller 60 is designed to synchronize the drive motor 50 of the take-off assist device 44 in conjunction with the input signal which it is receiving, and various control modes can be employed. The preferred method is the one referred to as speed control with current-compounding, and in this mode, the controller 60 drives the take-off assist device to not only match the precise speed reflected by the signal being received from the monitor but to try to increase this speed by a predetermined increment. Because, physically, the continuous tubing cannot be moved faster at the take-off assist device 44 than it is moving at the sizing and straightening rolls, this additional increment is reflected as tension in the tubing. The tension is generated because of the characteristics of the endless belts 48 which, because of their frictional characteristics and their extended (at least 24 inches long) regions of contact with the tubing, securely grip the tubing and essentially eliminate slippage between the belts and the tubing. As a result, substantially all of the excess power which the controller 60 feeds to the drive motor 50 is reflected as tension in the continuously moving tubing, and this tension results in a slightly shallower catenary.

The drive motor 50 is preferably a regenerative DC motor, and the controller 60 is, in essence, reading the monitored speed of the tubing at the sizing and straightening rolls 24 and reporting that an amount of current equal to X is needed to cause the motor to drive the endless belts 48 at precisely this speed. The controller 60 is set to add an additional increment Y of current to achieve the desired amount of tension, and thus the compounded current which is fed to the DC drive motor 50 is equal to $X + Y$. The actual control is such that this increased amount of current is provided by increasing the voltage across the DC motor 50.

Another mode of control is referred to as the digital speed mode, and the controller 60 again receives the input signal from the monitoring device 62 and this time drives the take-off assist device belts 48 to precisely match this speed. This mode also provides precision in the spatial relationship of the tubing downstream from the sizing rolls 24 through the water quench station; however, because of the absence of the tension, the tubing takes the form of a slightly deeper catenary throughout the heating, coating and baking stations.

The provision of a take-off assist device 44 of this type, which can grip the tubing without marring its finish, coupled with the control of the drive in conjunction with the monitored speed of the tubing as it leaves the sizing and straightening rolls 24 allows the overall tubing production line to be run at high speeds, e.g., up to 400 feet per minute, and it also allows the installation to be constructed in a way that there is no physical contact with the tubing over a span of 70 to 80 feet or more. The ability to be able to precisely determine the spatial location of the tubing at any location along its length is not only of significant value, as discussed hereinbefore, with respect to the application of the coating composition from spray heads or the like, but also with respect to the heating of the tubing. This is particularly true when induction heaters in the form of electrical coils are used, because they will be arranged so that the axis of the longitudinal coil closely surrounds and is coaxial with the continuously moving tubing, and accordingly positioning becomes very important. Therefore, the achievement of a precise catenary curve by means of the provision and indicated control of a belt-type take-off assist device allows very high production speeds to be achieved without sacrificing uniformity of coating.

The belt-type take-off assist device 44 is able to achieve the desired objective in handling coated tubing and even applying tension thereto without marring the exterior surface of the polymeric coating, which inherently contains some residual heat and has not achieved its full hardness. Whereas previous systems of this type, for example that disclosed in U.S. Pat. No. 3,616,983, used pairs of upper and lower rollers of concave peripheral shape to engage the peripheral surface of the coated tube and to thereby grip the tubing, inherently such rollers can cause a blemishing effect upon the outer surface of the coated tubing because the outer portions of the concave rollers move at a faster speed than the innermost portions, whereas all points on the coated tubing are moving linearly at exactly the same speed. In conclusion, it has been found that the employment of a take-off assist device of this construction in combination with its appropriate control significantly reduces the cost of providing polymer-coated lengths of steel tubing because such high production-line speed operation is reflected in lower unit cost.

Although the invention has been described with regard to certain preferred embodiments, it should be understood that various modifications as would be obvious to those having the ordinary skill in this art may be made without deviating from the scope of the invention, which is defined by the claims appended hereto. Various additional features of the invention are set forth in the claims which follow.

What is claimed is:

1. An installation for producing lengths of coated tubing from steel strip, which comprises, in combination, means for continuously supplying steel strip, means for roll-forming said steel strip into tubular configuration, means for welding said roll-formed strip into a continuous tube at a fast rate of speed, sizing roll means for treating said welded tubing, means for cleaning the exterior surface of said welded tubing, first heating means to raise the temperature of said cleaned tubing, a coating station for uniformly applying a polymeric coating to the exterior of said heated tubing, second heating means for heating said polymer-coated tubing to a desired baking temperature, a cooling station for rapidly lowering the temperature of said baked coated-tubing, said tubing being physically unsupported between a location upstream of said coating station and a location downstream of its entry into said cooling station, pulling means including a pair of elongated endless belts disposed in flanking relationship to said tubing and designed to grip said tubing over a longitudinal distance of at least about two feet, traveling shear means downstream of said pulling means for cutting said coated tubing into desired lengths, and means for controlling said pulling means so as to maintain said tubing in precise spatial location throughout said heating, coating and baking stations.

2. An installation in accordance with claim 1 wherein means is provided in approximate association with said sizing roll means for monitoring the precise speed of said welded tubing and creating a signal and wherein said control means receives said signal from said speed-monitoring means and drives said pulling means so as to try to move said coated tubing at a slightly faster speed than that indicated by said signal.

3. An installation in accordance with claim 1 wherein said pulling means is powered by an electric motor and said control means supplies electric power to said pulling means electric motor so as to maintain said welded tubing in tension between said sizing roll means and said pulling means.

4. An installation in accordance with claim 3 wherein said flanking endless belts are made of a material having a sufficiently high coefficient of friction that slippage between said belts and said coated tubing is essentially eliminated.

5. An installation in accordance with claim 1 wherein said coating station applies said polymer electrostatically as a powder.

6. An installation in accordance with claim 5 wherein said powder is uniformly applied in a manner so that said cut lengths have a polymeric coating not less than 4 mils thick and not greater than 6 mils thick.

7. An installation in accordance with claim 1 wherein said coating station applies said polymer as a solvent-based liquid coating.

8. An installation in accordance with claim 1 wherein galvanizing means is located between said cleaning means and said first heating means for applying a zinc coating to said welded steel tubing.

9. An installation in accordance with claim 1 wherein additional coating means is provided to apply a liquid solvent-based primer to said welded, cleaned tubing at a location upstream of said first heating means.

10. A method for producing coated tubing from steel strip, which method comprises the steps of continuously supplying steel strip, roll-forming said steel strip into tubular configuration, welding said roll-formed strip into a continuous tube at a fast rate of speed, sizing said welded tubing, cleaning the exterior surface of said welded tubing, heating said cleaned tubing, uniformly applying a polymeric coating to the exterior of said heated tubing, heating said polymer-coated tubing to a desired baking temperature, rapidly lowering the temperature of said baked coated tubing, said heating, coating and baking being performed while said tubing is physically unsupported, gripping said tubing over a longitudinal distance of at least about two feet and pulling said tubing in a manner so as to maintain said tubing in precise spatial location throughout said heating, coating and baking.

11. A method in accordance with claim 10 wherein said pulling is carried out in a manner to maintain said tubing in tension.

12. A method in accordance with claim 10 wherein the precise speed of said welded tubing is monitored at a location in approximate association with said sizing and a signal is created, said pulling is performed so as to try to move said coated tubing at a slightly faster speed than that indicated by said signal.

13. A method in accordance with claim 10 wherein said polymer is applied electrostatically as a powder.

14. A method in accordance with claim 13 wherein said powder is uniformly applied in a manner so that the resultant coated tubing has a polymeric coating not less than 4 mils thick and not greater than 6 mils thick.

15. A method in accordance with claim 10 wherein said polymer is applied by spraying a solvent-based liquid composition.

* * * * *

UNITED STATES PATENT AND TRADEMARK OFFICE

CERTIFICATE OF CORRECTION

PATENT NO. : 3,965,551

DATED : June 29, 1976

INVENTOR(S) : Arthur E. Ostrowski

It is certified that error appears in the above-identified patent and that said Letters Patent are hereby corrected as shown below:

Column 1, line 32, "employs" should read --lengths.--.

Column 1, line 33, "which" should read --designed--.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*